US008985883B2

(12) United States Patent
Wyatt et al.

(10) Patent No.: US 8,985,883 B2
(45) Date of Patent: Mar. 24, 2015

(54) CONTROL SURFACES FOR APPLICATOR WITH MOVEABLE APPLICATOR HEAD

(75) Inventors: Peter Jonathan Wyatt, Forest Hill, MD (US); David Edward Wilson, Reisterstown, MD (US); Florina Winter, Shanghai (CN); Neil Scott Beattie, Cambridge (GB); Colin Dennis Ager, Cambridgeshire (GB); Peter David Cauwood, Cambridge (GB); Thomas Elliot Rabe, Baltimore, MD (US)

(73) Assignee: The Procter & Gamble Company, Cincinnati, OH (US)

( * ) Notice: Subject to any disclaimer, the term of this patent is extended or adjusted under 35 U.S.C. 154(b) by 1248 days.

(21) Appl. No.: 12/181,717

(22) Filed: Jul. 29, 2008

(65) Prior Publication Data

US 2009/0154985 A1 Jun. 18, 2009

Related U.S. Application Data

(60) Provisional application No. 60/952,792, filed on Jul. 30, 2007.

(51) Int. Cl.
*A46B 11/00* (2006.01)
*A45D 40/26* (2006.01)
(Continued)

(52) U.S. Cl.
CPC ..... *A45D 40/265* (2013.01); *A46B 2200/1053* (2013.01); *A46B 13/02* (2013.01); *A46B 5/0095* (2013.01); *A46B 7/04* (2013.01)
USPC ..... 401/126; 401/129; 401/130; 132/218

(58) Field of Classification Search
CPC ... A45D 40/265; A45D 34/045; A46B 13/02; A46B 5/0095; A46B 7/04
USPC ..... 401/118, 126–131, 195; 132/216, 218
See application file for complete search history.

(56) References Cited

U.S. PATENT DOCUMENTS 386,453 A 7/1888 Roberts
474,795 A 5/1892 Hantman
(Continued)

FOREIGN PATENT DOCUMENTS

CH 585047 2/1977
CH 609238 2/1979
(Continued)

OTHER PUBLICATIONS

International Search Report PCT/US2008/071531 dated Dec. 15, 2008 including the Written Opinon of the International Searching Authority, 14 pages.

*Primary Examiner* — Tuan N Nguyen
(74) *Attorney, Agent, or Firm* — Carlos A. Garcia; Charles R. Ware; John G. Powell

(57) ABSTRACT

A cosmetic applicator comprising a handle having a proximal end and a distal end, wherein the handle comprises a drive; an applicator head operatively associated with the drive to move at least part of the applicator head relative to the handle; and a control surface disposed at the proximal end of the handle and operatively associated with the drive. The control surface may be rotatable about a control surface axis through a plurality of positions and the control surface axis may be aligned with the longitudinal axis of the handle. The control surface may be moveable through a plurality of positions. The applicator may comprise an additional control surface, such as a second control surface or temporary control surface, which may be operated independently or in combination with the first control surface.

22 Claims, 6 Drawing Sheets

(51) Int. Cl.

| | |
|---|---|
| ***A46B 13/02*** | (2006.01) |
| ***A46B 5/00*** | (2006.01) |
| ***A46B 7/04*** | (2006.01) |

(56) References Cited

U.S. PATENT DOCUMENTS

| | | | | |
|---|---|---|---|---|
| 2,290,454 | A | 7/1942 | Leon | |
| D145,158 | S | 7/1946 | Derham | |
| D154,653 | S | 8/1949 | Beckler | |
| 2,625,157 | A | 1/1953 | Lockhart | |
| D185,339 | S | 5/1959 | Wolff | |
| 2,975,467 | A | 3/1961 | Stanzel | |
| 3,132,743 | A | 5/1964 | Wolff | |
| 3,156,335 | A | 11/1964 | Richard | |
| 2,154,812 | A | 4/1967 | Hauser | |
| 3,431,571 | A * | 3/1969 | Kraus | 15/23 |
| 3,432,069 | A | 3/1969 | Craig | |
| 3,661,018 | A | 5/1972 | Keefer | |
| 3,699,952 | A | 10/1972 | Waters | |
| 3,998,235 | A | 12/1976 | Kingsford | |
| 4,056,111 | A | 11/1977 | Mantelet | |
| 4,089,079 | A | 5/1978 | Nicholson | |
| 4,186,733 | A | 2/1980 | Mogaki | |
| 4,302,901 | A | 12/1981 | Psyras | |
| 4,370,771 | A | 2/1983 | Gonzalvo | |
| 4,397,326 | A | 8/1983 | Formica | |
| 4,428,338 | A | 1/1984 | Skatsche | |
| D272,952 | S | 3/1984 | Holloway | |
| 4,490,877 | A | 1/1985 | Drumm | |
| 4,498,490 | A | 2/1985 | Seidler | |
| 4,632,136 | A | 12/1986 | Kingsford | |
| 4,679,271 | A | 7/1987 | Field | |
| 4,687,364 | A | 8/1987 | Kingsford | |
| 4,691,720 | A | 9/1987 | Schmitz | |
| 4,698,869 | A | 10/1987 | Mierau | |
| 4,744,377 | A | 5/1988 | Dolan, Jr. | |
| 4,766,432 | A | 8/1988 | Field | |
| D304,095 | S | 10/1989 | Gavin | |
| D306,967 | S | 4/1990 | Matsuura | |
| 4,914,988 | A | 4/1990 | Chang | |
| 4,922,934 | A | 5/1990 | Gatti | |
| 4,974,980 | A | 12/1990 | Gueret | |
| 4,988,502 | A | 1/1991 | Ounanian | |
| 5,007,442 | A | 4/1991 | Hirzel | |
| 5,061,103 | A | 10/1991 | Walsh-Smith | |
| 5,078,157 | A | 1/1992 | Golan | |
| 5,086,793 | A | 2/1992 | Kingsford | |
| 5,172,992 | A | 12/1992 | Ackermann | |
| 5,186,728 | A | 2/1993 | Fong | |
| 5,253,382 | A | 10/1993 | Beny | |
| 5,343,881 | A | 9/1994 | Golan | |
| 5,372,444 | A | 12/1994 | Lhuisset | |
| 5,383,242 | A | 1/1995 | Bigler | |
| 5,407,093 | A | 4/1995 | McGill | |
| D358,294 | S | 5/1995 | Letica | |
| 5,435,034 | A | 7/1995 | Bigler | |
| 5,492,136 | A | 2/1996 | Edmonds | |
| 5,575,579 | A | 11/1996 | Joulia | |
| D383,980 | S | 9/1997 | Abfier | |
| 5,784,742 | A | 7/1998 | Giuliani | |
| 5,794,296 | A | 8/1998 | Wong | |
| 5,816,728 | A | 10/1998 | Nardolillo | |
| 5,822,821 | A | 10/1998 | Sham | |
| 5,853,010 | A | 12/1998 | Suh | |
| D408,283 | S | 4/1999 | Tucker | |
| D409,800 | S | 5/1999 | Litton | |
| 5,937,871 | A | 8/1999 | Clay | |
| 5,956,791 | A | 9/1999 | Bassi | |
| 5,979,468 | A | 11/1999 | Blake, III | |
| D420,767 | S | 2/2000 | Coates | |
| D424,937 | S | 5/2000 | Tucker | |
| 6,142,692 | A | 11/2000 | Garcia | |
| 6,145,514 | A | 11/2000 | Clay | |
| 6,199,242 | B1 | 3/2001 | Masterman | |
| 6,295,994 | B1 | 10/2001 | Thayer | |
| 6,345,626 | B1 | 2/2002 | Bouix | |
| RE37,605 | E | 3/2002 | Clay | |
| 6,412,496 | B1 | 7/2002 | Gueret | |
| 6,450,178 | B1 | 9/2002 | Clay | |
| 6,454,674 | B1 | 9/2002 | Krzesicki et al. | |
| 6,565,276 | B1 | 5/2003 | Diaz | |
| 6,616,366 | B1 | 9/2003 | Weihrauch | |
| 6,652,888 | B2 | 11/2003 | Rhoades | |
| 6,691,716 | B2 | 2/2004 | Neuner | |
| 6,811,340 | B2 | 11/2004 | Petit | |
| 6,948,780 | B1 | 9/2005 | Litman et al. | |
| 7,025,068 | B2 | 4/2006 | Dumler | |
| 7,089,946 | B2 | 8/2006 | Rousselet | |
| D530,857 | S | 10/2006 | Black | |
| 7,165,906 | B2 | 1/2007 | Dieudonat | |
| D548,973 | S | 8/2007 | Dawson | |
| D550,078 | S | 9/2007 | Henry | |
| 7,578,071 | B2 * | 8/2009 | Goldstein et al. | 401/126 |
| 7,832,954 | B2 * | 11/2010 | Gueret | 401/129 |
| 7,845,873 | B2 | 12/2010 | Kress | |
| 7,927,032 | B2 * | 4/2011 | Sanchez | 401/129 |
| 8,001,981 | B2 | 8/2011 | Jeong et al. | |
| 8,118,507 | B2 | 2/2012 | Kress et al. | |
| 8,317,423 | B2 | 11/2012 | Marotta et al. | |
| 8,327,858 | B2 | 12/2012 | Neuner et al. | |
| 2001/0018061 | A1 | 8/2001 | Rhoades | |
| 2001/0050089 | A1 | 12/2001 | Fitjer | |
| 2002/0069726 | A1 | 6/2002 | Adler | |
| 2003/0165550 | A1 | 9/2003 | Rhoades | |
| 2004/0195063 | A1 | 10/2004 | Simonis | |
| 2004/0234323 | A1 | 11/2004 | Albisetti | |
| 2004/0244809 | A1 | 12/2004 | Gueret | |
| 2005/0086752 | A1 | 4/2005 | Lee | |
| 2005/0142093 | A1 | 6/2005 | Skover | |
| 2005/0250076 | A1 | 11/2005 | Rhoades | |
| 2005/0268409 | A1 | 12/2005 | Blaustein | |
| 2006/0032512 | A1 * | 2/2006 | Kress et al. | 132/218 |
| 2006/0042647 | A1 | 3/2006 | Vogel | |
| 2006/0051155 | A1 | 3/2006 | Delage | |
| 2006/0076033 | A1 | 4/2006 | Bouix | |
| 2006/0228157 | A1 | 10/2006 | Dieudonat | |
| 2006/0272666 | A1 | 12/2006 | Wyatt | |
| 2006/0272667 | A1 | 12/2006 | Wyatt | |
| 2006/0272668 | A1 | 12/2006 | Wyatt | |
| 2007/0186948 | A1 * | 8/2007 | Kim et al. | 132/218 |
| 2007/0231050 | A1 | 10/2007 | Thiebaut | |
| 2007/0261868 | A1 | 11/2007 | Gross | |
| 2007/0272269 | A1 | 11/2007 | Wyatt | |
| 2007/0289602 | A1 | 12/2007 | Simmons | |
| 2008/0011316 | A1 | 1/2008 | Malvar | |
| 2008/0087296 | A1 | 4/2008 | Gueret | |
| 2008/0196735 | A1 | 8/2008 | Wyatt | |
| 2008/0196736 | A1 | 8/2008 | Wyatt | |
| 2008/0236607 | A1 | 10/2008 | Lee | |
| 2009/0025746 | A1 | 1/2009 | Kim | |
| 2009/0071499 | A1 | 3/2009 | Wyatt | |
| 2009/0071500 | A1 | 3/2009 | Wyatt | |
| 2009/0154985 | A1 | 6/2009 | Wyatt | |
| 2009/0226238 | A1 | 9/2009 | Lane | |
| 2010/0000566 | A1 | 1/2010 | Wyatt | |
| 2010/0089414 | A1 | 4/2010 | Wyatt | |
| 2010/0269846 | A1 | 10/2010 | Wyatt | |

FOREIGN PATENT DOCUMENTS

| | | | |
|---|---|---|---|
| CN | 2320094 | Y | 5/1999 |
| DE | 3833358 | | 1/1996 |
| DE | 19950665 | | 5/2000 |
| DE | 20210482 | | 10/2002 |
| EP | 0289726 | B1 | 8/1992 |
| EP | 0371501 | B1 | 8/1997 |
| EP | 0845305 | B1 | 10/2002 |
| EP | 0848920 | B1 | 3/2003 |
| EP | 1621104 | A | 5/2006 |
| FR | 1565296 | | 4/1969 |
| FR | 2345964 | A | 10/1977 |
| FR | 2701197 | A | 3/1995 |
| FR | 200216283 | | 6/2004 |
| GB | 846639 | A | 8/1960 |

(56) References Cited

FOREIGN PATENT DOCUMENTS

| | | | |
|---|---|---|---|
| GB | 1502532 | A | 3/1978 |
| GB | 2132884 | | 7/1984 |
| GB | 2304645 | | 3/1997 |
| GB | 2284750 | A | 10/1997 |
| JP | 04040905 | | 2/1992 |
| JP | 5329024 | | 12/1993 |
| JP | 8289815 | | 11/1996 |
| JP | 1996289815 | A | 11/1996 |
| JP | 2005095531 | | 4/2005 |
| KR | 200326065 | | 8/2003 |
| KR | 2020030012684 | | 8/2003 |
| KR | 200334143 | | 11/2003 |
| KR | 2020030025327 | | 11/2003 |
| KR | 200341762 | | 2/2004 |
| KR | 2020030030514 | | 2/2004 |
| KR | 200356837 | | 7/2004 |
| KR | 2020040011077 | | 7/2004 |
| KR | 200358513 | | 8/2004 |
| KR | 2020040010980 | | 8/2004 |
| KR | 200393379 | | 8/2005 |
| KR | 2020050016644 | | 8/2005 |
| KR | 200396785 | | 9/2005 |
| KR | 2020050016643 | | 9/2005 |
| KR | 200404002 | | 12/2005 |
| KR | 2020050028145 | | 12/2005 |
| KR | 200416525 | | 5/2006 |
| KR | 200416536 | | 5/2006 |
| KR | 2020060004384 | | 5/2006 |
| KR | 2020060004826 | | 5/2006 |
| WO | WO9403125 | A | 2/1994 |
| WO | WO9700650 | A1 | 1/1997 |
| WO | WO0054623 | A1 | 9/2000 |
| WO | WO2004077987 | A1 | 9/2004 |
| WO | WO2006130643 | A | 5/2006 |
| WO | WO2006090343 | A1 | 8/2006 |
| WO | WO2006130644 | A2 | 12/2006 |
| WO | WO2006132459 | A1 | 12/2006 |
| WO | WO2007060438 | A2 | 5/2007 |
| WO | WO2007094552 | A1 | 8/2007 |
| WO | WO2007060438 | A3 | 9/2007 |
| WO | WO2008051067 | A2 | 5/2008 |

* cited by examiner

CONTROL SURFACES FOR APPLICATOR WITH MOVEABLE APPLICATOR HEAD

CROSS REFERENCE TO RELATED APPLICATION

This application claims the benefit of U.S. Provisional Application No. 60/952,792 filed Jul. 30, 2007.

FIELD OF THE INVENTION

The present disclosure is directed to a cosmetic applicator with a moveable applicator head, and in particular to control surfaces associated with the applicator.

BACKGROUND OF THE INVENTION

Various types of cosmetic applicators are known in the art. Mascara applicators have been proposed in which an applicator head is supported by a stem for motion relative to a handle. The force for moving the applicator head may be electrically driven, such as described in U.S. Pat. No. 4,056,111 to Mantelet. These applicators assist the user by automating, at least to some degree, the process of application of the mascara to the eyelash, and thereby address some of the difficulties and inefficiencies experienced with applicators where the applicator head is fixed to the handle.

One drawback of electrically driven mascara applicators is that users may turn them on accidentally or unknowingly, resulting in unintended power drainage. This can happen, for example, if a mascara applicator is in a user's purse and is jostled. There is a desire to develop an electrically driven mascara applicator which may be locked when not in use so as to prevent unintended operation.

Another drawback of electrically driven mascara brushes is that the user may not know what motion or function will occur when they turn the brush on. There exists a need to inform the user of the motion capabilities of the mascara applicator and let the user select the motion or function she prefers. This problem is addressed by providing a control surface on the handle whereupon the user may choose the motion, speed, direction, function, etc. she prefers. There is a desire to locate the control surface where it is comfortable and intuitive for users to operate, even during application.

SUMMARY OF THE INVENTION

The present invention is directed to a cosmetic applicator. A first exemplary embodiment comprises a handle having a proximal end and a distal end, wherein the handle comprises a drive; an applicator head operatively associated with the drive to move at least part of the applicator head relative to the handle; and a control surface disposed at the proximal end of the handle and operatively associated with the drive. The control surface is rotatable about a control surface axis through a plurality of positions and the control surface axis is aligned with the longitudinal axis of the handle.

A second exemplary embodiment comprises a handle having a proximal end and a distal end, wherein the handle comprises a drive; an applicator head operatively associated with the drive to move at least part of the applicator head relative to the handle; and a control surface disposed at the proximal end of the handle and operatively associated with the drive, the control surface moveable through a plurality of positions. The plurality of positions comprises at least a first position corresponding to a first drive state, a second position corresponding to a second drive state, and a third position corresponding to a third drive state. Movement of the control surface among the plurality of positions causes the drive to operate according to the first drive state, the second drive state, and the third drive state. Two or more drive states correspond to no motion of the applicator head and one or more drive states correspond to motion of at least part of the applicator head.

A third exemplary embodiment comprises a handle having a proximal end and a distal end, wherein the handle comprises a drive; an applicator head operatively associated with the drive to move at least part of the applicator head relative to the handle; a first control surface disposed at the proximal end of the handle and operatively associated with the drive, the first control surface moveable through a plurality of positions; and a second control surface disposed at the proximal end of the handle and operatively associated with the drive. The second control surface may be operated independently or in combination with the first control surface.

A fourth exemplary embodiment comprises a handle having a proximal end and a distal end, wherein the handle comprises a drive; an applicator head operatively associated with the drive to move at least part of the applicator head relative to the handle; a first control surface disposed at the proximal end of the handle and operatively associated with the drive, the first control surface moveable through a plurality of positions; and a temporary control surface. The temporary control surface is operatively associated with the drive and prohibits operation of the first control surface. Operation of the temporary control surface causes the drive to operate according to a state corresponding to motion of the applicator head.

BRIEF DESCRIPTION OF THE DRAWINGS

While the specification concludes with claims particularly pointing out and distinctly claiming the subject matter regarded as the present invention, it is believed that the invention will be more fully understood from the following description taken in conjunction with the accompanying drawings. Some figures may have been simplified by the omission of selected elements for the purpose of more clearly showing other elements. Such omissions of elements are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 1:
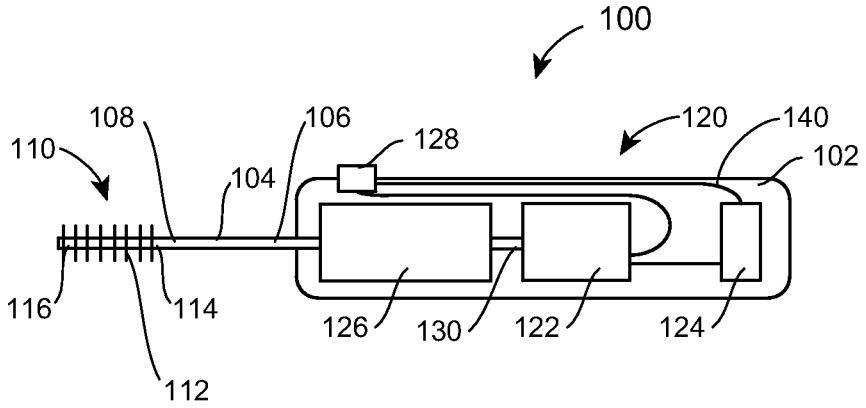
FIG. 1 is a schematic of an automated applicator according to the present disclosure with a proximal control surface.
Figure 24:
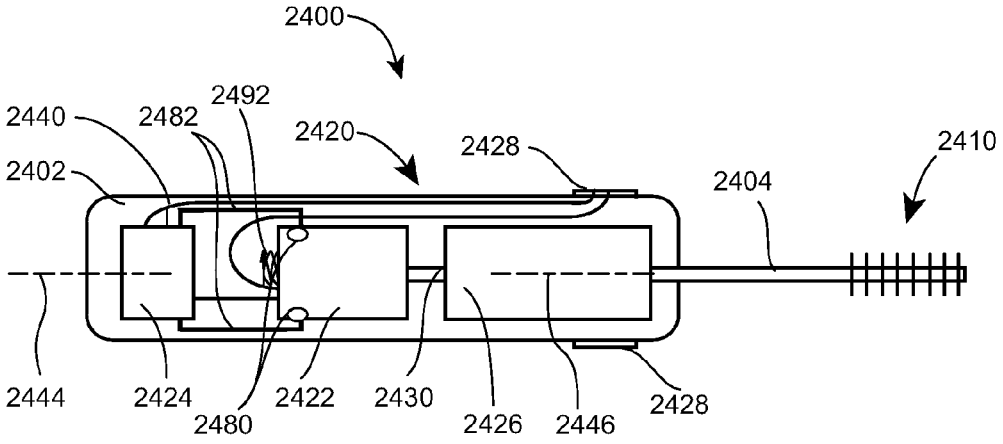
FIG. 24 is a schematic of an automated applicator according to the present disclosure with a proximal control surface.
Figure 25:
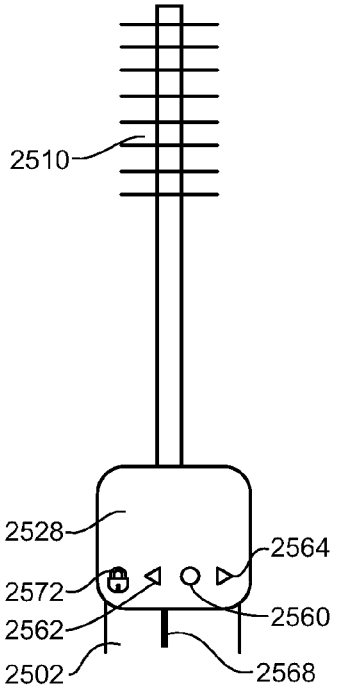
FIG. 25 is a partial plan view of an alternative indicator layout for an automated applicator, showing a plurality of positions on the control surface and an indicator on the handle.
Figure 27A:
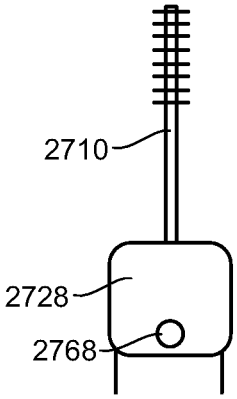
FIGS. 27A, 27B, and 28 are partial plan views of alternative indicator layouts for an automated applicator.
Figure 27B:
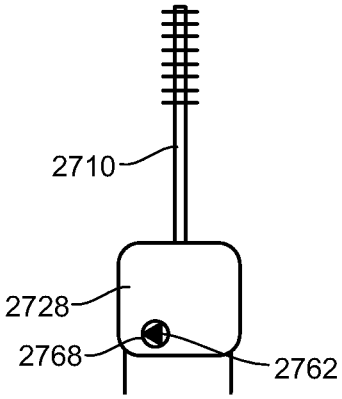
Figure 28:
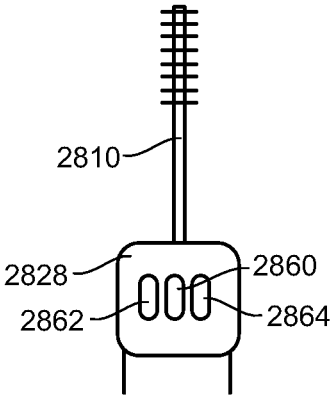

The present disclosure details a variety of cosmetic applicators having proximal control surfaces and systems incorporating such applicators. FIG. 1 introduces a general embodiment of the applicator, while FIGS. 2-23 illustrate various alternative embodiments of the proximal control surface. FIGS. 24-26 illustrate different embodiments of the proximal control surface. FIGS. 27A, 27B, and 28 illustrate embodiments having different indicator elements. FIGS. 29-32 illustrate various embodiments of automated applicator having at least one control surface in addition to the proximal control surface. FIG. 33 illustrates an applicator similar to that illustrated in FIG. 1 in combination with a source of cosmetic. Throughout, a numbering convention has been adopted such that similar features of the various embodiments have been numbered in a similar manner. One of ordinary skill in the art would realize that various elements of the embodiments discussed and shown may be combined or modified.

Definitions

The term "cosmetic applicator" or "applicator" refers to an apparatus, device or system used to apply cosmetic material, such as mascara, to a keratinous material, such as eyelashes.

The term "applicator element" refers to a structure from which a cosmetic material, such as mascara, is transferred to a keratinous material, such as eyelashes.

The term "applicator head" refers to one or more applicator elements and a structure that supports the applicator element (s). According to certain embodiments, the applicator head may comprise protrusions and a core from which the protrusions extend or depend.

The term "attached" refers to elements being connected or united by adhering, fastening, bonding, etc. by any method suitable for the elements being joined together. Many suitable methods for attaching elements together are well-known, including adhesive bonding, mechanical fastening, etc. Such attachment methods may be used to attach elements together either continuously or intermittently.

The term "operatively associated" refers to configurations whereby an element is directly secured to another element by attaching the element directly to the other element, and to configurations whereby an element is indirectly secured to another element by attaching the element to intermediate member(s) that is(are) in turn attached to the other element.

The term "disposed" is used to mean that an element(s) exists in a particular place or position as a unitary structure with other elements or as a separate element operatively associated with other elements.

The term "drive" refers to an apparatus, device or system that moves a driven element, such as an applicator head or applicator element, which is operatively associated with the drive. The drive may comprise a motor, a transmission, and a source of power for the motor. The structure and operation of the motor may vary according to the desired motion to be achieved between the applicator head and handle.

The term "state" refers to either a drive state or another state, such as paused, stopped, or locked which may be employed by the applicator to achieve cosmetic benefits like lifting, separating, and depositing of the lashes. States may correspond to different speeds, directions, movements, intensities, frequencies, etc. The applicator head may, in whole or in part, rotate about the longitudinal axis of the stem. Or, the head may, in whole or in part, translate along the longitudinal axis of the stem. The head may, in whole or in part, vibrate. The drive may move the head according to any combination of rotational, translational, and vibrational motion relative to the longitudinal axis of the stem, and this motion may occur at a fixed speed, frequency, amplitude or time duration, or the speed, frequency, amplitude or time duration may vary. See, for example, U.S. patent application Ser. No. 11/143,176. In addition, states may correspond to other effects, such as heat, cold, light, sound, product dosing, torque control, magnetic fields, mixing, or dosing of a product onto an applicator.

The term "paused" refers to a state wherein the motor and battery power contacts are discontinuous. There is no motion of the applicator head in the paused state.

The term "stopped" or "locked" refers to a state wherein the position is at a greater angle of rotation from the nearest other switch position. A stopped or locked state requires greater force to get into and out of the state than is required to get into and out of a paused state or drive state. Discontinuity of the motor and battery power contacts in a lock position are farther apart than in a paused state. The motor contacts are further isolated from the battery contacts than in any other position, in particular, isolation that occurs when in a pause position. In a locked state, the applicator head may be prohibited from moving while it is within the bottle.

The term "motor" refers to one of, a combination of, or variation of the following. The motor may be a mechanical motor with a source of potential mechanical energy in the form of a resilient member—a spring or rubber band, for example. Alternatively, the motor may be an electric motor, in which case the drive may also comprise a power source in the form of a battery, for example, operatively associated with the motor to provide the necessary voltage and current. Where the motor is an electric motor, the voltage and current may even be provided by a power source external to the handle, such as an embodiment wherein the motor is operatively associated with an electric mains via an electrical outlet or to a separate battery, for example. In other embodiments, the motor may be in the form of a pretensable spring or element, it may be in the form of an electromagnet, it may be a vibratory motor powered by a piezocrystal, or any number of forms or variations therein.

The term "protrusion" refers to a member that extends or depends generally away from or into a base surface, such as of an applicator head. As such, a protrusion provides a localized area that is not continuous with the surrounding base surface.

Cosmetic Applicator

As illustrated in FIG. 1, an automated cosmetic applicator 100 according to the present disclosure may also comprise a handle 102 and a stem 104 having a first end 106 operatively associated with handle 102 and a second end 108. Applicator 100 may comprise an applicator head 110 that comprises one or more applicator elements 112, such as protrusions. Head 110 may be attached to second end 108 of stem 104, such that the first end 114 of applicator head 110 is operatively associated with handle 102 and the second end 116 of head 110 is free. The illustration of handle 102 is merely exemplary, and is not intended to be limiting. In fact, details of handle 102 have been omitted to more clearly show other elements of applicator 100.

As also illustrated in FIG. 1, applicator 100 comprises a drive 120. Drive 120 may comprise a motor 122, a power source 124, and a transmission 126. Power source 124 may comprise an inhibitor, for example a pull tab, that limits operation of drive 120 except when the pull tab is removed (to permit completion of the electrical circuit, for example). Transmission 126 operatively associates motor 122 with stem 104, and in doing so, operatively associates drive 120 with head 110 and, thus, applicator elements 112. In all or only in certain operative states, drive 120 may move applicator head 110, in whole or in part, relative to handle 102. In certain states, drive 120 may be disengaged and/or inoperatively associated with head 110 such that head 110 has no or limited relative motion relative to handle 102, while in other states, drive 120 may be engaged and/or operatively associated with head 110 to move head 110 relative to handle 102. Alternatively, drive 120 and/or head 110 may be secured against motion in certain operative states. In such alternative embodiments, the drive 120 or head 110 may be engaged, in whole or in part, by an element, such as a switch, that operatively associates drive 120 or head 110 fixedly with handle 102, such that no or only limited motion may occur between head 110 and handle 102.

According to certain embodiments, a drive circuit 140 may be operatively associated with motor 122 and power source 124 to control operation of motor 122. Drive circuit 140 may comprise a single control surface or multiple control surfaces that are in series or parallel. In one embodiment, drive circuit 140 comprises a control surface 128 to turn motor 122 on and off, or operatively or inoperatively associate motor 122 with power source 124. As for transmission 126, its structure and operation may also vary according to the desired motion to be achieved. In fact, transmission 126 may transform, in whole or in part, the motion of motor 122 prior to operatively associating with applicator head 110. For example, rotational motion of motor 122 (or more particularly, its motor shaft 130) may be transformed, at least in part, to translational motion. In addition or in the alternative, transmission 126 may reduce the speed of motor 122 to a rotational speed appropriate for head 110. In certain embodiments, transmission 126 may be omitted if shaft 130 does not rotate faster than the desired rotational speed of head 110. In other embodiments, transmission 126 may not be required if motor 122 is capable of providing variable motions or speeds. Drive 120 may comprise elements other than or in addition to motor 122, power source 124, and transmission 126. For example, a torque converter (see U.S. patent application Ser. No. 11/677,326).

Control Surfaces

As noted relative to FIG. 1, control surface 128 according to the present disclosure is located at the proximal end of handle 102, which is the end closest to stem 104. It will be recognized that this may have certain advantages over control surfaces placed closer to the midpoint or distal end of handle 102. When held, it is more likely that the user's thumb and/or forefinger will be in the region of the proximal end of handle 102 than the midpoint or distal end of handle 102. By placing control surface 128 in the proximal region, the manipulation of control surface 128 by the thumb and/or forefinger may be facilitated; also, the user may easily balance handle 102 in her hand using a familiar gripping means (i.e. not compensating for an unnatural position of the control surface which makes users employ other fingers) that allows the user to control the applicator motion intuitively and unconsciously. It is important that the user maintain their familiar way to hold the applicator, and be able to control the applicator without conscious decisions that require looking at the control surface, using two hands, holding the applicator in an unnatural way, or using appendages other than the forefinger and/or thumb.

FIGS. 2-23 illustrate a number of different applicator embodiments showing control surface placement options and design. According to this disclosure, the control surface may be positioned at one end or the other of the handle, such that the control surface may be at either the proximal end (near the stem) or distal end of the handle. Preferred control surfaces are located at the proximal end of the handle; these may be referred to as "proximal control surfaces" as well as simply "control surfaces." However, in referring to the control surfaces as being located "at" the proximal end of the handle, it will be recognized that, as illustrated, this does not limit the positioning of the control surfaces such that they must be located at the very end of the handle; rather, the control surfaces may be near the proximal end of the handle. Importantly, additional control surfaces need not be located in any specific area; for instance, a primary control surface may be located at the proximal end of the handle, while an additional control surface may be located at the proximal end or the midpoint of the handle. Or, an additional control surface may be positioned at the distal end of the handle. In some embodiments, the control surface axis is aligned with the longitudinal axis of the handle. In other embodiments, the control surface axis is orthogonal to the longitudinal axis of the handle. In still further embodiments, the control surface axis is at an angle other than 0, 90, 180, or 270 degrees from the longitudinal axis of the handle.

Figure 2:
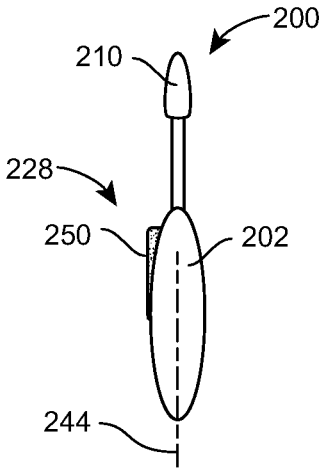
FIG. 2 is a plan view of an automated applicator according to the present disclosure with a proximal control surface in the form of a single push button.

FIG. 2 shows an applicator 200 comprising a control surface 228 in the form of a single button 250. Button 250 may be in the form of a push button which may be depressed radially inward towards the longitudinal axis 244 of the handle 202; button 250 may actuate a toggle switch. Applicator head 210 may revolve in one direction or the other depending on the state of the toggle switch. In another embodiment, button 250 may be capable of being depressed through a plurality of positions, each position associated with a different state for the applicator head.

It will be recognized that a number of other input devices may be used in place of a button. Operation of the control surface may involve manipulation of one or more buttons, collars, switches, conductive or inductive-responsive surfaces, pressure or temperature-responsive surfaces, etc. These input devices may provide a number of discrete input states, or a continuous plurality of input states. Moreover, the input devices may maintain an input state until the user manipulates the input device to another input state, or the input device may maintain the input state for a limited time period, which time period may be set by the user or predetermined by the input device. For example, the input devices may rely upon changes in pressure or temperature. Alternatively, the input devices may be in the form of electrical contacts which the user selectively connects, for example, by placing a finger across the contacts, to provide an input device. Or, operation may require the presence of an RFID chip or the like.

Figure 3:
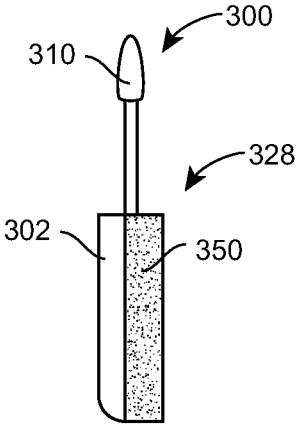
FIG. 3 is a plan view of an automated applicator according to the present disclosure with a proximal control surface in the form of a button extending the length of the handle.

Moreover, it will be recognized that the input device does not need to have a shape coextensive with the control surface. For example, as illustrated in FIG. 3, the applicator 300 comprises a control surface 328 in the form of a button 350 that extends the length of the handle 302. However, control surface 328 may be defined only by that portion of button 350 at the proximal end of handle 302, where the applicator head 310 is operatively associated with the drive. It is not necessary that button 350 be manipulable elsewhere along button 350, although according to certain embodiments that is a possibility.

Figure 4:
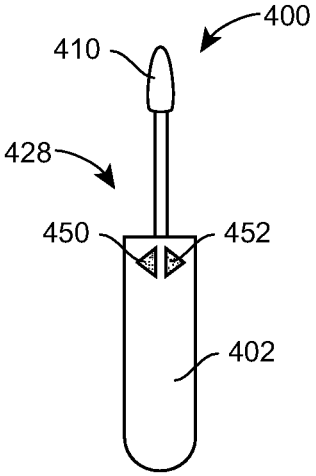
FIG. 4 is a plan view of an automated applicator according to the present disclosure with a proximal control surface in the form of a plurality of push buttons.

FIG. 4 illustrates an embodiment of a control surface 428 including a plurality of buttons 450, 452. Buttons 450, 452 are shaped to provide an indication of their intended function. That is, depression of button 450 causes motion of the applicator head 410 in one direction, while depression of button 452 causes motion of head 410 in the other direction. In one embodiment, both buttons 450, 452 are biased to a stopped position, such that when neither button 450, 452 is depressed, head 410 is not moving. Or, buttons 450, 452 may be linked, such that when one button 450 is depressed, the other button 452 is not.

Figure 5:
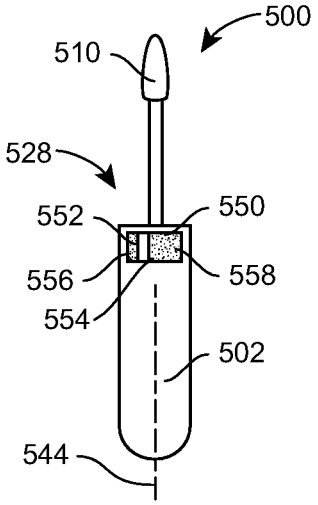
FIG. 5 is a plan view of an automated applicator according to the present disclosure with a proximal control surface in the form of a slide oriented in the transverse direction.

As a further alternative, FIGS. 5-8 illustrate a series of applicators comprising control surfaces that respond to motion of the thumb or forefinger along a line of action that is not directed radially inward to the longitudinal axis of the applicator. For instance, FIG. 5 illustrates a control surface 528 comprising a slide 550 that is disposed transversely to the longitudinal axis 544 of the handle 502. Slide 550 comprises a tab 552 that moves in the transverse direction from a central position 554 to either of two extreme positions 556, 558. In one embodiment, movement of tab 552 from central position 554 in one direction or the other causes applicator head 510 to move in that direction, with the speed of head 510 being directly related to the distance moved by tab 552 relative to positions 556, 558. In other embodiments, tab 552 may be biased toward central position 554. Or, tab 552 may be biased towards extreme position 556 and there may be one or more positions to which tab 552 may move.

Figure 6:
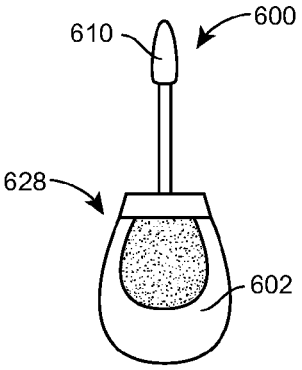
FIG. 6 is a plan view of an automated applicator according to the present disclosure with a proximal control surface in the form of a single button capable of tilting.
Figure 7:
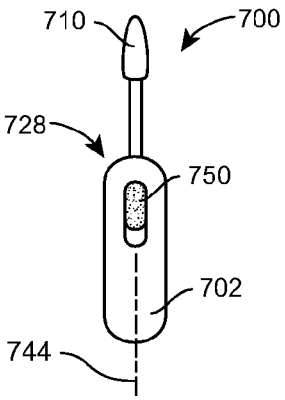
FIG. 7 is a plan view of an automated applicator according to the present disclosure with a proximal control surface in the form of a slide oriented in the longitudinal direction.
Figure 8:
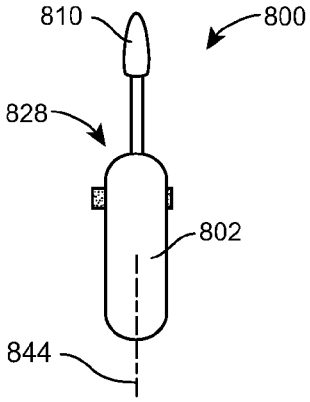
FIG. 8 is a plan view of an automated applicator according to the present disclosure with a proximal control surface in the form of a toggle that passes through the proximal end of the handle.

The embodiment of FIG. 6 is similar to the embodiment of FIG. 5 in that movement of a thumb across the control surface 628 can cause the applicator head 610 to move in one manner or another. The embodiment of FIG. 7 is also similar to the embodiment of FIG. 5 in that the control surface 728 is defined by a slide 750, although slide 750 is aligned along an axis parallel to the longitudinal axis 744 of the handle 702, rather than transverse to handle 702. The embodiment of FIG. 8 is similar to FIGS. 5 and 6 in that movement of the control surface 828 transverse to the longitudinal axis 844 of the handle 802 may cause the applicator head 810 to move in one direction or the other, for example. However, according to the embodiment of FIG. 8, control surface 828 moves relative to handle 802, such that when control surface 828 is depressed in the right side of handle 802, head 810 rotates to the right, and when the control surface is depressed to the left side of handle 802, head 810 rotates to the left.

The embodiments of FIGS. 9-23 illustrate a set of related control surfaces. That is, all of the control surfaces in the embodiments illustrated in FIGS. 9-23 are moveable about an axis. In the embodiments in FIGS. 9-19, the axis about which the control surface moves is aligned with or parallel to the longitudinal axis of the handle. According to the embodiments illustrated in FIGS. 21-23, the control surface moves about an axis that is orthogonal to the longitudinal axis. Despite the fact that the majority of illustrated embodiments have an axis that is aligned with or parallel to the longitudinal axis, this is not intended to indicate a preference for one type of embodiment over or to the exclusion of another. Moreover, the disclosure also would embrace embodiments wherein the axis is neither aligned with/parallel to nor orthogonal to the longitudinal axis.

Figure 9:
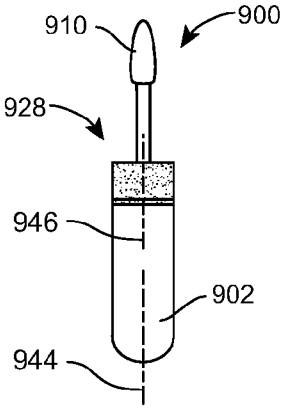
FIG. 9 is a plan view of an automated applicator according to the present disclosure with a proximal control surface mounted for rotation about an axis parallel to the longitudinal axis of the handle.
Figure 10:
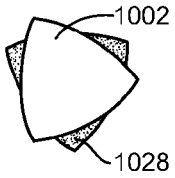
FIGS. 10-13 are end views of different embodiments of the control surface of FIG. 9.
Figure 11:
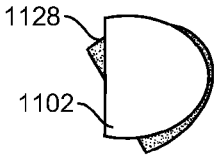
Figure 12:
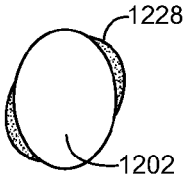
Figure 13:
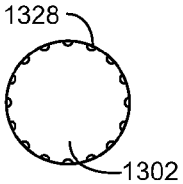

Starting with FIG. 9, the control surface 928 has an axis 946 about which it moves (rotates) that is aligned with the longitudinal axis 944 of the applicator 900. According to certain embodiments, control surface 928 may comprise a collar that extends about the entire periphery of the handle 902. Alternatively, control surface 928 may be disposed on or about a sector of the periphery of handle 902. Control surface 928 may be biased toward a first position, which position is associated with a paused or stopped/locked state for the applicator head 910. In some embodiments, control surface 928 may be manipulated so as to move through an entire revolution or even several revolutions about axis 946, with the movement of control surface 928 being associated with head 910 passing through a series of states, such as different directions, speeds, types of motion, no motion, locked, etc. In other embodiments, control surface 928 may be revolved around only a fraction of the full revolution, for instance, about 90 degrees of the full circumference. So, for example, the more control surface 928 is moved in one direction, the higher the amplitude of a lateral side-to-side motion. In one embodiment, control surface 928 moves through various bi-directional motion (oscillating) states. In a preferred embodiment, control surface 928 moves through the states of: stopped/locked, movement in a first direction (e.g. counterclockwise rotation), paused, and movement in a second direction (e.g. clockwise rotation). In some embodiments, there may be a fifth position, stopped/locked, such that the control surface 928 moves through the states of: stopped/locked, movement in a first direction (e.g. counterclockwise rotation), paused, movement in a second direction (e.g. clockwise rotation), and stopped/locked. One of ordinary skill in the art will recognize that an oscillatory motion which moves more in one direction than another over multiple periods of oscillation, such as two steps in a clockwise direction and one step in a counterclockwise direction, is still considered, overall, movement in a clockwise direction.

As illustrated in FIG. 9, the applicator has a circular geometry about the longitudinal axis 944 of the handle 902. Consequently, looking along axis 944 of handle 902 from either end of applicator 900, the profile would be of a circle. But, the control surface profile may take many different forms to enable a user to grasp and operate the control surface. The control surface may be ergonomically contoured; for example, the control surface may have a triangular, rectangular, or polygonal cross-section. Alternatively, the control surface may be a combination of curves and straight edges, for example, a concave control surface collar surrounding a portion of the handle. FIGS. 10-13 illustrate a number of different profiles that may be used for the handle and control surface. According to the embodiment of FIG. 10, the handle 1002 and the control surface 1028 may have a generally triangular profile. According to the embodiment of FIG. 11, the handle 1102 and the control surface 1128 may have a generally D-shaped profile. According to the embodiment of FIG. 12, the handle 1202 and control surface 1228 may have a generally elliptical profile. Finally, according to the embodiment of FIG. 13, the handle 1302 may have a generally circular profile with a series of longitudinally-oriented grooves, while the control surface 1328 may have a more uniformly circular profile.

Figure 14:
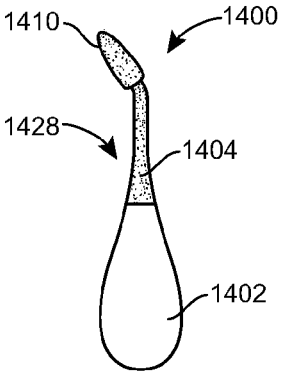
FIG. 14 is a plan view of an automated applicator according to the present disclosure with a proximal control surface similar to that of FIG. 9, but disposed about the stem.
Figure 15:
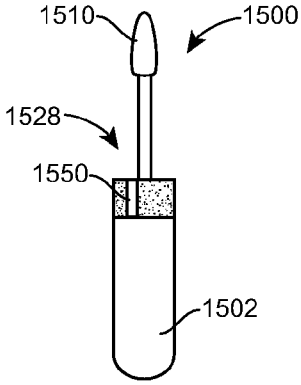
FIG. 15 is a plan view of an automated applicator according to the present disclosure with a proximal control surface similar to that of FIG. 9, but also having a graspable surface.

FIG. 14 illustrates a variation on the embodiment of FIG. 9 wherein the control surface 1428 is arranged as a shroud about the stem 1404, which is connected to the applicator head 1410. According to this embodiment, stem 1404 passes through the control surface/shroud 1428, permitting shroud 1428 to be manipulated and to rotate about the same axis as stem 1404. In another embodiment, the shroud may not move. The applicator may comprise a flexible drive shaft. Also in another embodiment, the applicator head may be situated at an angle from the handle axis and be moveable. Similar to the embodiment of FIG. 9, control surface 1428 may be manipulated in one direction, or the other, or about the axis through one full revolution, several revolutions, or only a fraction of a full revolution. Control surface 1428 may be biased toward one position, or may be free to revolve about the axis of the control surface.

Control surface 1428 may be transparent or translucent, for example, to permit visualization of stem 1404, a feature which may be used in any or all of the embodiments disclosed herein and which is not restricted to only the embodiment of FIG. 14. As an alternative, only a part or portion of control surface 1428 may be transparent or translucent. As a further alternative, a portion of the structure on which the control surface is mounted or to which the control surface is attached may be transparent or translucent. For example, the portion of the handle just below control surface 1428 in the embodiment of FIG. 14, or behind buttons 450, 452 in the embodiment of FIG. 4 may be transparent or translucent.

Figure 16:
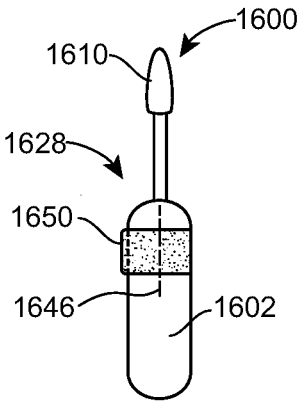
FIG. 16 is a plan view of an automated applicator according to the present disclosure with a proximal control surface similar to that of FIG. 9, but additionally having a graspable tab.
Figure 17:
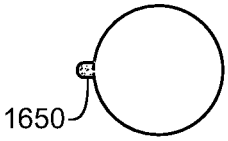
FIGS. 17 and 18 are end views of different embodiments of the control surface of FIG. 16.
Figure 18:
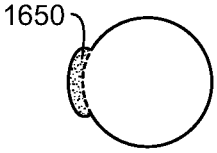
Figure 19:
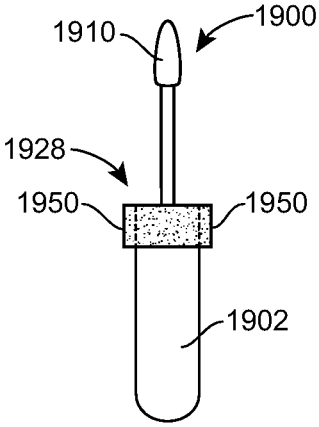
FIG. 19 is a plan view of an automated applicator according to the present disclosure with a proximal control surface similar to that of FIG. 16, but having a plurality of graspable tabs.

FIGS. 15-19 illustrate a series of embodiments wherein the control surface has at least one graspable surface that may permit the user to determine a position to grasp the control surface. For example, the applicator 1500 comprises a graspable surface 1550 that may have a surface effect that makes surface 1550 have a different tactile response than the remainder of the control surface 1528. For example, surface 1550 may have a different level of friction or roughness than the remainder of the control surface, or surface 1550 may be made of a different material than the remainder of control surface 1528, such as a rubber or rubber-like material or a gel-like material, for example. While surface 1550 may have a different surface effect, surface 1550 is not intended to depend substantially from the remainder of control surface 1528. In contrast, FIG. 16 illustrates a tab 1650 that depends from the control surface 1628 to permit the user to place a thumb, for example, against tab 1650 to manipulate control surface 1628. It is not a requirement that the control surface be located at the extreme-most proximal point on the handle to be described as a proximal control surface. As illustrated in the embodiment of FIG. 16, control surface 1628 is set back some distance from the extreme-most proximal end of the handle 1602. FIGS. 17 and 18 are end views of the embodiment of FIG. 16; they illustrate that tab 1650 may vary in thickness about the axis of revolution 1646 of control surface 1628 as shown in FIG. 16. FIG. 19 is another variation on this general theme, and has a pair of opposing tabs 1950, from which it will be recognized that a plurality of such tabs 1950 may be provided as desired.

Figure 20:
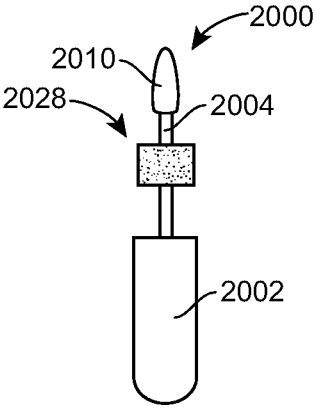
FIG. 20 is a plan view of an automated applicator according to the present disclosure with a proximal control surface similar to that of FIG. 9, but positioned separate from the handle.
Figure 21:
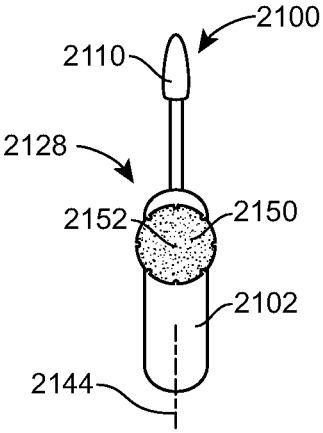
FIG. 21 is a plan view of an automated applicator according to the present disclosure with a proximal control surface mounted for rotation about an axis orthogonal to the handle longitudinal axis.

The embodiment of FIG. 20 illustrates an alternative wherein the control surface 2028 is positioned beyond the proximal end of the handle 2002, and along the stem 2004 of the applicator 2000.

As mentioned above, FIGS. 21-23 illustrate a set of embodiments wherein the control surface is not confined or limited to an orientation wherein the control surface moves about an axis aligned with or parallel to the axis of the handle. According to the embodiment of FIG. 21, the control surface 2128 of the applicator 2100 comprises a wheel 2150 that rotates or is pivotable about an axis 2152 that is orthogonal to the longitudinal axis 2144 of the handle 2102. While a wheel is shown, it will be recognized that control surface 2128 could have as easily been a sector of the wheel instead. Moreover, as was explained above, control surface 2128 may be biased toward one position from which control surface 2128 may be moved, or control surface 2128 may be moved through one or more revolutions.

Figure 22:
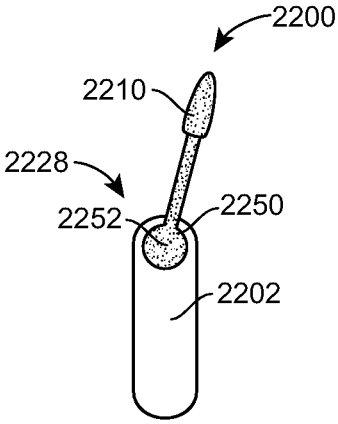
FIG. 22 is a plan view of an alternative automated applicator with a proximal control surface in the form of a surface mounted for rotation about an orthogonal axis.

According to the embodiment of FIG. 22, the control surface 2228 of the applicator 2200 comprises a pivot or joint 2250 to which the applicator head 2210 is attached or through which head 2210 passes. Application of force to the side of head 2210 causes joint 2250 to move about the axis 2252, and may cause head 2210 to rotate depending on which side of handle 2202 head 2210 moves.

Figure 23:
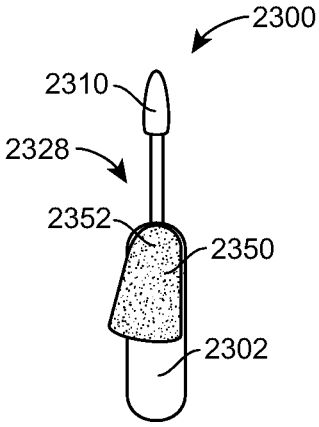
FIG. 23 is a plan view of another alternative automated applicator with a proximal control surface in the form of a surface mounted for rotation about an orthogonal axis.

In the embodiment of FIG. 23, the control surface 2328 of the applicator 2300 is defined by a shroud 2350 that is attached to a proximal end of the handle 2302 at a pivot point 2352. Force applied to one side or the other of the shroud 2350 causes shroud 2350 to move about axis 2352. Similar to the embodiment of FIG. 22, movement of shroud 2350 about axis 2352 may cause the applicator head 2310 to rotate depending on the movement of shroud 2350 more to one side or the other of handle 2302.

A further embodiment of an applicator according to the present disclosure is introduced in the schematic of FIG. 24. The exemplary applicator 2400 comprises a handle 2402, a stem 2404, and an applicator head 2410. Handle 2402 comprises a drive 2420. In particular, handle 2402 has a proximal end and a distal end, and drive 2420 is operatively associated with head 2410 at the proximal end of handle 2402 to move at least part of head 2410 relative to handle 2402. According to the embodiment as illustrated, the movement of head 2410 relative to handle 2402 is rotational in nature. In other embodiments, the movement may be lateral, vibrational, etc. Also according to the embodiment as illustrated, drive 2420 comprises a motor 2422, a transmission 2426, a power source 2424—preferably in the form of one or more batteries, and two sets of contacts 2480, 2482. One set of contacts 2480 is operatively associated with motor 2422, while the second set of contacts 2482 is operatively associated with batteries 2424. In one embodiment, sets of contacts 2480, 2482 are moveable relative to each other in directions aligned with or parallel to the longitudinal axis of handle 2402 between a first setting and a second setting. In the first setting, first and second sets of contacts 2480, 2482 are inoperatively associated with each other. In the second setting, first and second sets 2480, 2482 are operatively associated with each other. As illustrated, a resilient member 2492 may be used to bias drive 2420 toward a certain position. In a preferred embodiment, resilient member 2492 is in the form of a compression spring, is disposed between motor 2422 and power source 2424. In other embodiments, resilient member 2492 may be disposed near a control surface. As further shown in FIG. 24, a control surface 2428 may be disposed at the proximal end of handle 2402, operatively associated with drive 2420, and moveable through a plurality of positions about an axis 2446 aligned with a longitudinal axis 2444 of handle 2402.

Figure 26A:
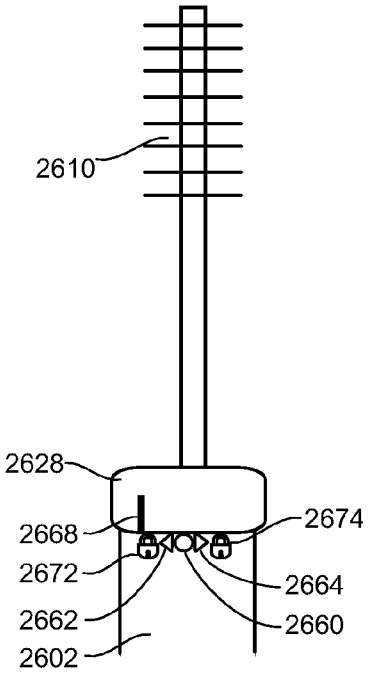
FIGS. 26A and 26B are partial plan views of alternative indicator layouts for an automated applicator, showing a plurality of positions on the handle and an indicator on the control surface.
Figure 26B:
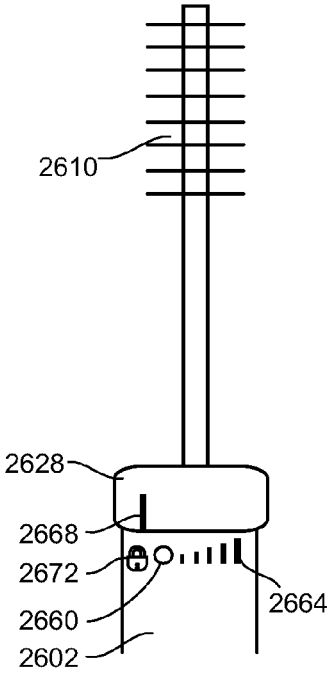

FIGS. 25, 26A, and 26B show different control surfaces embodiments. In a preferred embodiment, as shown in FIG. 25, each of the plurality of positions 2560, 2562, 2564, 2572 is marked on the outer surface of the control surface 2528, such that when a particular position 2560, 2562, 2564, 2572 marking is aligned with an indicator 2568, for example, a stripe marked on the outer surface of the handle 2502, an indication is provided to the user regarding the position of control surface 2528. In other embodiments, every position in the plurality of positions need not be marked; for instance, with an applicator having various speed positions, only the min and max positions need be marked.

In a preferred embodiment, as depicted in FIG. 25, the plurality of positions is associated with a first drive state, a second drive state, a third drive state, and a fourth drive state. Movement of control surface 2528 through the plurality of positions causes drive 2420 (see FIG. 24) to operate according to the first drive state, the second drive state, the third drive state, and the fourth drive state. Positions 2560, 2562, 2564, 2572 provide visual guidance to the user of the applicator 2500 as to the operation of the applicator head 2510. First position 2560 is associated with a circular-shaped icon and a first drive state, which corresponds to no movement of head 2510. Second position 2562 is associated with a left-pointing arrow-shaped icon and a second drive state, which corresponds to a first direction of movement of head 2510. Third position 2564 is associated with a right-pointing arrow-shaped icon and a third drive state, which corresponds to a second direction of movement of head 2510 which is opposite the first direction of movement. Fourth position 2572 is associated with a lock-shaped icon and a fourth drive state, which corresponds to no movement of head 2510. As such, control surface 2528 of the preferred embodiment moves successively through fourth 2572, second 2562, first 2560, and third 2564 positions and their corresponding states, wherein the first state corresponds to no motion of the applicator head, the second state corresponds to a first motion of at least part of the applicator head, the third state corresponds to no motion of applicator head, and the fourth state corresponds to a second motion of at least part of the applicator head. The second and fourth positions may be separated by a position related to no motion.

Control surface 2528 may be formed in accordance with the embodiments discussed above. In a particular embodiment, control surface 2528 may be biased, through the use of resilient member 2492 (shown in FIG. 24) (preferably in the form of a compression spring) operatively associated with the control surface, toward first position 2560, such that control surface 2528 moves alternatively between first position 2560, second 2562, and third 2564 positions.

In another embodiment, as shown in FIG. 26A, each of the plurality of positions 2660, 2662, 2664, 2672, 2674 is marked on the handle 2602, such that when a particular position 2660, 2662, 2664, 2672, 2674 is aligned with an indicator 2668, for example, a stripe marked on the control surface 2628, an indication is provided to the user regarding the position of control surface 2628. In a preferred embodiment, position 2672 corresponds to a locked state, position 2662 corresponds to a motion drive state, position 2660 corresponds to a paused state, position 2664 corresponds to another motion drive state, and position 2674 corresponds to another locked state.

In the embodiment shown in FIG. 26B, each of the plurality of positions 2660, 2664, 2674 is marked on the handle 2602, such that when a particular position 2660, 2664, 2674 is aligned with an indicator 2668, for example, a stripe marked on the control surface 2628, an indication is provided to the user regarding the position of control surface 2628. In a preferred embodiment, position 2672 corresponds to a locked state, position 2660 corresponds to a paused state, and position 2664 corresponds to another motion drive state. Between any two positions there may be a continuum of states which correspond to varying speeds or intensities of the motions of the two positions. As shown, as indicator 2668 moves from position 2660 to position 2664, the intensity increases. Or, between any two positions there may be one or more states corresponding to no motion of the applicator head.

In a preferred embodiment, when an applicator is screwed onto or off of a product bottle, there is potential for the applicator to get turned on accidentally and waste power. For instance, if an applicator has five positions—such as lock, reverse, pause, forward, lock—when unscrewing the handle from the bottle, the applicator may turn itself on and off as it is removed from the bottle, and end up in the off position so the user does not even notice the intermediate motion. To solve this problem, the applicator may be forced to power off when a user screws the handle off of or back onto the bottle.

In one embodiment, the handle may be pressed on to the bottle and pass through a "click" to engage the seal between the handle and bottle; this thrusting motion of the handle meeting the bottle may also be used to disengage the motor, and pulling the handle out of the bottle again may act to engage it again. As one of ordinary skill in the art would appreciate, a threaded engagement between the handle and bottle is not the only way to seal the two together.

In a preferred embodiment, the control surface preferentially seeks an off position as the applicator is pulled from the bottle or replaced in the bottle. Referring to FIG. 26A, indicator 2668 would be located at stop/lock position 2672 when application torque is applied to the bottle—in other words, when handle 2602 is tightened onto the bottle (not shown). Conversely, indicator 2668 would be located at stop/lock position 2674 when removal torque is applied to remove handle 2602 from the bottle—in other words, when handle 2602 is removed from the bottle for use. One of ordinary skill in the art would recognize that the thread may be opposite of traditional way—For example, if a left-handed thread is present in the applicator, indicator 2668 would be in stop/lock position 2674 when application torque is applied, and in stop/lock position 2672 when removal torque is applied.

Of course, the control surfaces and positions illustrated in FIGS. 25 and 26 are only two embodiments; many other variations of control surfaces, positions, and icons may be used with applicators according to the present disclosure. For example, in place of geometric symbols, alphanumeric symbols may be used. In particular embodiments, there may be a resilient member (not shown, but discussed above in relation to FIG. 24) associated between the control surface and the handle which biases the drive or control surface to a certain position, for example, to keep the indicator centered when not in use. Or, geometric differences may cause the drive or control surface to bias to a certain position, for instance, ramping so it can come to rest or interference to a center locator.

As illustrated in the embodiments of FIGS. 27A and 27B, it is not necessary that the positions be visible in all states or at all times. A position 2762 associated with the control surface 2728 is not visible through the indicator window 2768 provided when control surface 2728 is in a first state (shown in FIG. 27A). However, manipulation of control surface 2728 into a second state (illustrated in FIG. 27B) causes movement of indicator 2768, which movement reveals position 2762.

Additionally, rather than using icons disposed on the control surface, FIG. 28 illustrates an embodiment wherein positions 2860, 2862, 2864 in the form of lights, such as light emitting diodes (LEDs), may be used to signal that the control surface 2828 has been moved between states, resulting a change of state of the drive. In certain embodiments, illumination of position 2862 could be used to signal rotation of the applicator head 2810 in a first direction, illumination of position 2864 could be used to signal rotation of head 2810 in a second direction, and illumination of position 2860 could be used to signal no rotation. Illuminating positions may be used to signal other events as well, such as low battery, prolonged use (which could lead to product fatigue or excessive battery use), activation of an additional temporary effect such as motion or heat, etc. The intensity of the light may be proportional to the product benefit. For instance, high-speed motion might be represented by a bright light, while low-speed motion is represented by a dim light. A series of lights may light up in order to indicate the intensity of motion. Alternatively, lights could indicate the load on the applicator. For example, red lights might signal to the user that too much torque is being applied, so the user should pull the applicator away from the eye.

Another means of communicating with the user is via sound. Sound indicators on the applicator may be triggered by similar things as discussed above regarding lights. As speed increases, so may the pitch or volume of a sound; sound may act as a metaphor for the motion type—e.g. if a turbo switch (in the form of an additional control surface) is pressed for a high speed oscillatory rotation, then the corresponding sound may also oscillate its pitch at the same or different frequency of motion change.

Figure 29:
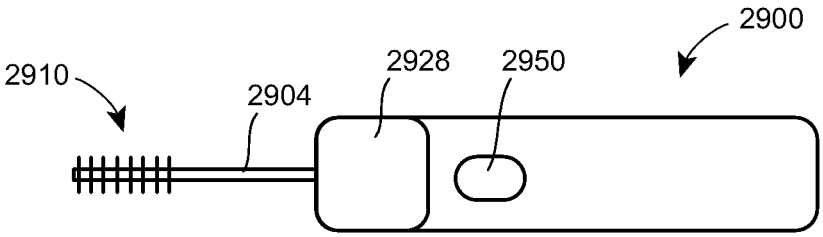
FIG. 29 is a plan view of an automated applicator having an additional control surface that may be used to vary the operation of the proximal control surface or the operation of the drive in response to manipulation of the proximal control surface.
Figure 30:
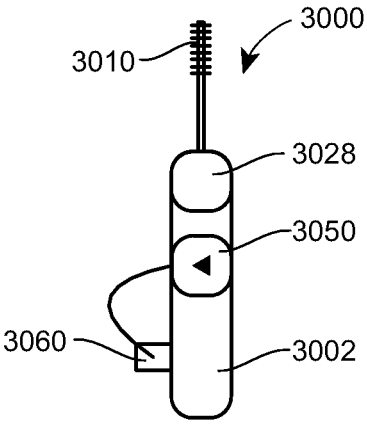
FIG. 30 is a schematic view of an automated applicator having an additional control surface that is separable from the automated applicator.
Figure 31:
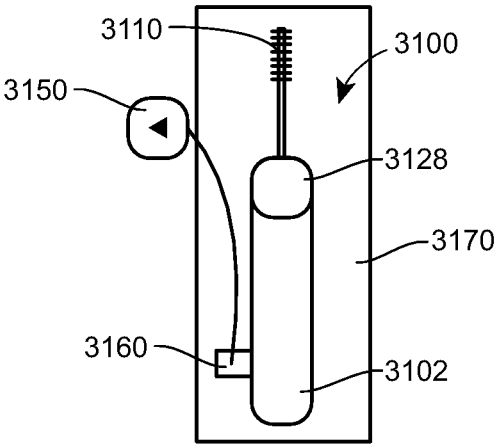
FIG. 31 is a schematic view of an automated applicator having an additional control surface that is separable from the automated applicator and disposed outside the secondary packaging.

Still other embodiments according to the present disclosure are illustrated in FIGS. 29-31. In these embodiments, the control surface disposed at the proximal end of the handle (also called the "first control surface") may be combined with an additional control surface disposed anywhere on the applicator or secondary packaging. The additional control surface may be operated independently or in combination with the first control surface to influence the drive. Certain of these additional control surfaces may modify the operation of the first control surface, although it will be recognized that modifications of the operation of the first control surface may be achieved by mechanisms that do not require direct user input; for example, an orientation sensor (such as a gyro) that enables or disables the first control surface depending on the orientation of the applicator. While these embodiments illustrate automated applicators wherein there is a first control surface and one additional control surface, it will be recognized that more than one additional control surface may also be provided.

According to the embodiment of FIG. 29, an applicator 2900 comprises a first control surface 2928 and an additional, second control surface 2950. Operation of second control surface 2950 may influence the operation of first control surface 2928 or the response of the drive (not shown) in response to operation of first control surface 2928. For example, second control surface 2950 may be associated with the power supply so as to either operatively or inoperatively associate the drive with the power supply. In this fashion, operation of first control surface 2928 would not cause the drive to assume one of the plurality of states (forward and reverse, for example), unless second control surface 2950 is also placed in an operative state to operatively associate the drive with the power supply. Alternatively, second control surface 2950 may influence either the signal provided by first control surface 2928 or the drive directly to vary the sensitivity of first control surface 2928 to manipulation by the user. For example, certain users may desire a more responsive first control surface 2928, while other users may desire a less responsive control surface; by varying the level of signal provided by first control surface 2928 according to its manipulation, applicator 2900 may provide either mode of operation.

According to another embodiment, second control surface 2950 may provide a locking benefit. Second control surface 2950 may be disposed separate from first control surface 2928, or it may be integrated into or disposed on top of first control surface 2928. Second control surface 2950 may be operatively associated with a mechanical device that actually prohibits movement of first control surface 2928 relative to the handle when second control surface 2950 is in a locked state. Or, upon placing second control surface 2950 in the locked state, applicator head 2910 may move in a particular direction until second control surface 2950 is moved to an unlocked state. Alternatively, second control surface 2950 may be operatively associated with a control circuit and may provide a signal to the control circuit to hold a particular state assumed in response to a signal received from first control surface 2928 until second control surface 2950 is manipulated further. As a further alternative, the locked state may be maintained for a predetermined amount of time (e.g., in response to a time delay circuit or mechanical analog), whereupon head 2910 may assume a state such as off. In another embodiment, second control surface 2950 may be represented as a position on first control surface 2928, such as a lock position. Relatedly, second control surface 2950 may function as a battery engage/disengage mechanism.

In another embodiment, a second control surface may be used to record or play a "motion experience." An applicator may be capable of moving in, for example, a volumizing rotational motion, a separating oscillation-rotation motion, and a lifting motion. Once users find a way they like to apply their cosmetic, it is desirable to be able to repeat the application experience. So, a user might engage the second control surface so that the preferred application motions and timing may be recorded and calculated by a microprocessor circuit. Then, the user may use the same procedure each day by using the second control surface to play back the recording. Or, the applicator may be able to "sync" with a retail display to transfer an operation mode, or "motion experience," to the applicator. In this way, the second control surface may just be an override that plays back this "application demo" that the applicator acquired from the retail display. This demonstrates to users the multiple benefits encompassed in one applicator. Or, users may be rewarded for coming back to a retail display, for instance by re-programming their applicator by syncing it with the display to acquire one or many motion experiences.

In some embodiments, second control surface 2950 may cause a change in the operation of the drive of applicator 2900, and in particular in the motion of head 2910. Second control surface 2950 may alter the current state, for example, switch from a unidirectional motion to an oscillating motion, add lateral backwards-and-forwards motion in addition to rotation, or add vibration in addition to rotation. In some embodiments, second control surface 2950 is a push button, depression of which may result in an increase or decrease in the speed, frequency, intensity, amplitude, or time duration of the motion of head 2910. The change may be timed, such that for each manipulation of second control surface 2950, the speed is increased for a fixed amount of time, or the change may continue until manipulation of second control surface 2950 ceases. Whether an increase in speed would result in an increase in linear speed or angular speed, for example, would vary according to the normal operation of head 2910.

In other embodiments, second control surface 2950 may introduce a new state such as heat, cold, light, sound, product dosing, torque control, mixing, etc. In one embodiment, second control surface 2950 may generate resistive heating. In another embodiment, second control surface 2950 may turn on a light that is directed towards the user or head 2910. Or, the light may be directed through at least a part of head 2910 itself. In another embodiment, second control surface 2950 may enable product delivery from the handle through the stem to the applicator head.

Figure 32:
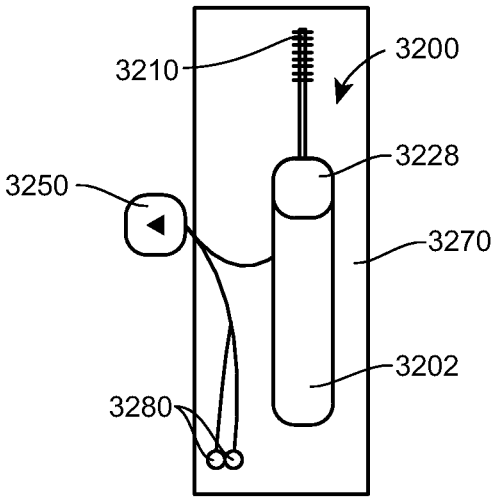
FIG. 32 is a schematic view of an automated applicator having an additional control surface that is separable from the automated applicator, disposed outside the secondary packaging, and may be operatively associated with an external power supply.
Figure 33:
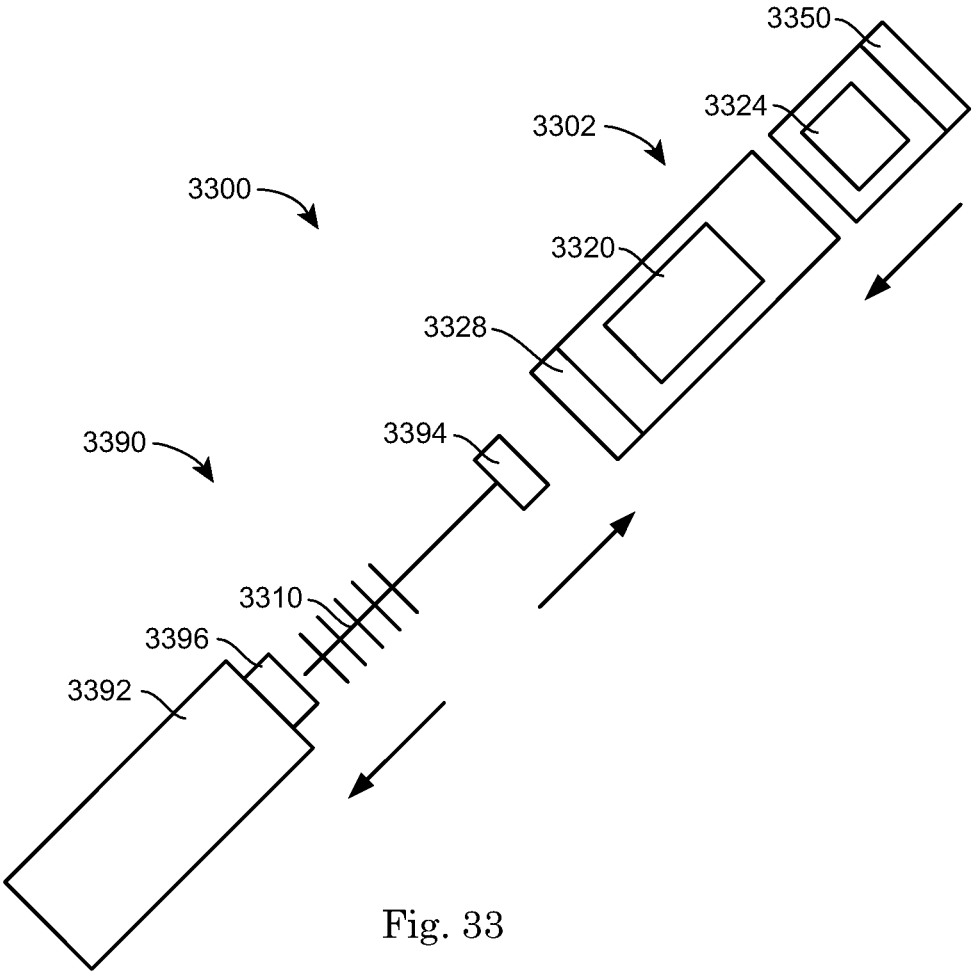
FIG. 33 is a partially-exploded schematic of a system including an applicator according to FIG. 1.

The embodiments according to FIGS. 30-32 illustrate an applicator with a first control surface and an additional, temporary control surface, wherein the temporary control surface may be separated from the remainder of the applicator. The temporary control surface may be used to permit a prospective customer to operate the drive and observe the motion of the applicator head without providing the prospective customer access to the first control surface. This may be important where the control surface 3028, 3128, 3228 is at the proximate end of the handle 3002, 3102, 3202, close to the applicator head 3010, 3110, 3210. Certain prospective customers may be hesitant to purchase the applicator if they believe other users have had their fingers near head 3010, 3110, 3210 because of the perception of an unsanitary condition. As illustrated in FIG. 30, the temporary control surface 3050 may be disposed on or near handle 3002, but perhaps in a different location than first control surface 3028 so as to permit manipulation through secondary packaging without manipulating first control surface 3028, for example. As illustrated in FIGS. 31 and 32, the temporary control surface 3150, 3250 is disposed outside of secondary packaging 3170, 3270 to permit operation of the applicator 3100, 3200 while it is retained within packaging 3170, 3270. Temporary control surface 3050 may be removed by the user after purchase of applicator.

While temporary control surface 3050, 3150, 3250 may permit the prospective customer to operate the drive in the same manner as it might be operated using control surface 3028, 3128, 3228, it may also be possible for temporary control surface 3050, 3150, 3250 to permit operation of the drive only according to certain of the operative states possible through use of first control surface 3028, 3128, 3228. For example, in the embodiments in FIGS. 30 and 31, temporary control surface 3050, 3150 may operate to close the circuit between the power supply and the drive of the applicator 3000, 3100. According to such an embodiment, applicator 3000, 3100 would then operate according to the state of first control surface 3028, 3128, which may be set before placement in secondary packaging 3170. Thus, operation of temporary control surface 3050, 3150 may result in motion of head 3010, 3110 in a single direction. While temporary control surfaces 3050, 3150, 3250 have been illustrated with a single button or input device, it will be recognized that a plurality of buttons or input devices may be used instead.

In certain embodiments, as illustrated in FIGS. 30 and 31, temporary control surface 3050, 3150 is associated with an insert 3060, 3160 that may be operatively associated with the power source of applicator 3000, 3100. Insert 3060, 3160 acts as an insulating strip and may be used to connect temporary control surface 3050, 3150 to the power source. Other structures may be used to operatively associate the control surface with a power source external to the applicator, such as inductive couplings. In other embodiments, the temporary control surface may be operatively associated with a power source separate from that of the applicator. FIG. 32 illustrates one such embodiment, wherein temporary control surface 3250 is operatively associated with applicator 3200, and to a set of contacts 3280 via a pair of leads. Contacts 3280 may be operatively associated with a power source by placing contacts 3280 in contact with a pair of contacts associated with the power source, which may be incorporated into a display.

Assembly and Use of the Applicator

Turning back to FIG. 1, applicator 100 may be manufactured as a single unit. That is, applicator head 110 may be operatively associated with drive 120 in such a fashion that attempts to inoperatively associate head 110 with drive 120 may result in damage to one or both of head 110 and drive 120, rendering head 110 and/or drive 120 inoperable. Alternatively, head 110 and/or drive 120 may be operatively associated with handle 102 to the same effect. Applicator 100 may also be packaged and sold together with a bottle of the cosmetic, mascara for example.

However, the components of applicator 100 may also be manufactured so as to be packaged and sold separately. An example of such a system is shown in FIG. 33. An applicator head 3310 may be selectively detachable from the drive 3320 and/or handle 3302, such that a variety of heads 3310 may be used with a given drive 3320 and/or handle 3302. This permits the user to change between heads 3310 having different applicator element profiles or applicator element distributions without the need to obtain or purchase more than a single drive 3320/handle 3302 unit. According to these embodiments, one or more heads 3310 and a drive 3320/handle 3302 unit may be packaged and sold as a kit, and heads 3310 may be packaged and sold separately from a drive 3320/handle 3302 unit as refills or replacements.

In some embodiments, applicator head 3310 may be packaged and sold as a unit 3390 with a bottle 3392 of cosmetic material (for example, mascara). In certain embodiments, head 3310 may comprise a threaded portion 3394 that engages a similarly threaded portion 3396 of the bottle 3392. Head 3310 may then be operatively associated with drive 3320/handle 3302 unit at the time of use. Drive 3320/handle 3302 may be packaged and sold with the combination 3390 of head 3310 and bottle 3392 as part of a kit, or drive 3320/handle 3302 may be packaged and sold separately from head 3310/bottle 3392.

Notably, applicator head 3310 is not the only component which may be packaged and sold separately. As also illustrated in FIG. 33, the power source 3324 may be selectively detachable from the remainder of drive 3320. In one embodiment, removable power source 3324 may be in the form of a removable compartment which may snap or screw onto the handle. Power source 3324 may comprise only power, or power plus additional features. The power source compartment may be color-coded or branded with indicia or iconic drawings indicating the intended cosmetic benefit to the user. In another embodiment, power source 3324 may be operatively associated with a drive circuit to form a type of intelligent power source that may not only provide voltage and current to drive 3320, but also may control the speed of applicator head 3310 to provide a non-fixed rotational speed, or provide some other control function (directionality of motion, for example). Power source 3324 may also have its own control surface 3350, which may operate according to the additional control surfaces referenced above. Selection and combination of one intelligent power source or another with the remainder of drive 3320 may significantly influence the performance of applicator 3300, and even control surface 3328. Power source 3324 may be packaged and sold with heads 3310 separate from other elements of applicator 3300.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cosmetic applicator comprising:

a handle having a proximal end and a distal end, wherein the handle comprises a drive;

an applicator head operatively associated with the drive to move at least part of the applicator head relative to the handle; and a control surface disposed at the proximal end of the handle and operatively associated with the drive; wherein the control surface is rotatable about a control surface axis through a plurality of positions;

wherein the control surface axis is aligned with the longitudinal axis of the handle;

wherein the plurality of positions comprises at least a first position corresponding to a first state, a second position corresponding to a second state, and a third position corresponding to a third state; and wherein rotation of the control surface among the plurality of positions causes the drive to operate according to the first state, the second state, and the third state; wherein two or more of the states correspond to no motion of the applicator head and one or more of the states correspond to motion of at least part of the applicator head; wherein the first position, the second position, and the third position provide a first visual guidance, a second visual guidance, and a third visual guidance to a user of the applicator as to operation of the applicator head.

2. A cosmetic applicator comprising:

a handle having a proximal end and a distal end, wherein the handle comprises a drive;

an applicator head operatively associated with the drive to move at least part of the applicator head relative to the handle; and a control surface disposed at the proximal end of the handle and operatively associated with the drive, the control surface moveable through a plurality of positions;

wherein the plurality of positions comprises at least a first position corresponding to a first state, a second position corresponding to a second state, and a third position corresponding to a third state;

wherein movement of the control surface among the plurality of positions causes the drive to operate according to the first state, the second state, and the third state; wherein two or more of the states correspond to no motion of the applicator head and one or more of the states correspond to motion of at least part of the applicator head; wherein the first position, the second position, and the third position provide a first visual guidance, a second visual guidance, and a third visual guidance to a user of the applicator as to operation of the applicator head.

3. The applicator of claim 2, wherein the plurality of positions comprises a fourth position corresponding to a fourth state;

wherein movement of the control surface among the plurality of positions causes the drive to operate according to the first state, the second state, the third state, and the fourth state;

wherein the first state corresponds to no motion of the applicator head, the second state corresponds to a first motion of at least part of the applicator head, the third state corresponds to no motion of the applicator head, and the fourth state corresponds to a second motion of at least part of the applicator head; and wherein the second position and fourth position are separated by a position corresponding to no motion.

4. The applicator of claim 3, wherein the first motion and second motion are rotating motions, and wherein one of the first motion or second motion rotates in a first direction and the other of the first motion or second motion rotates in a second direction.

5. The applicator of claim 3, wherein the first motion and second motion are rotating motions, and wherein the first motion rotates in a first direction at a first speed and the second motion rotates in the first direction at a second speed that varies from the first speed.

6. The applicator of claim 3, wherein the first motion and second motion are vibrating motions, and wherein the first motion vibrates at a first frequency and the second motion vibrates at a second frequency that varies from the first frequency.

7. The applicator of claim 3, wherein the first motion and second motion are translating motions, and wherein the first motion translates with a first amplitude and the second motion translates with a second amplitude that varies from the first amplitude.

8. The applicator of claim 3, wherein the first motion and second motion are oscillating motions, and wherein the first motion oscillates with a first oscillating motion and the second motion oscillates with a second oscillating motion varies from the first oscillating motion.

9. The applicator of claim 3, wherein the first motion is a rotating motion and the second motion is a translating motion.

10. The applicator of claim 3, wherein the first motion is a rotating motion and the second motion is a vibrating motion.

11. The applicator of claim 3, wherein the first motion is a rotating motion and the second motion is an oscillating motion.

12. The applicator of claim 3, wherein the first motion is an oscillating motion and the second motion is a motion selected from the group including: a translating motion and a vibrating motion.

13. The applicator of claim 1, wherein the plurality of positions comprises a fourth position corresponding to a fourth state;

wherein rotation of the control surface among the plurality of positions causes the drive to operate according to the first state, the second state, the third state, and the fourth state;

wherein the first state corresponds to no motion of the applicator head, the second state corresponds to a first motion of at least part of the applicator head, the third state corresponds to no motion of the applicator head, and the fourth state corresponds to a second motion of at least part of the applicator head; and wherein the second position and fourth position are separated by a position corresponding to no motion.

14. The applicator of claim 13, wherein the first motion and second motion are rotating motions, and wherein one of the first motion or second motion rotates in a first direction and the other of the first motion or second motion rotates in a second direction.

15. The applicator of claim 13, wherein the first motion and second motion are rotating motions, and wherein the first motion rotates in a first direction at a first speed and the second motion rotates in the first direction at a second speed that is greater than the first speed.

16. The applicator of claim 13, wherein the first motion and second motion are vibrating motions, and wherein the first motion vibrates at a first frequency and the second motion vibrates at a second frequency that is greater than the first frequency.

17. The applicator of claim 13, wherein the first motion and second motion are translating motions, and wherein the first motion translates with a first amplitude and the second motion translates with a second amplitude that is greater than the first amplitude.

18. The applicator of claim 13, wherein the first motion and second motion are oscillating motions, and wherein the first motion oscillates with a first oscillating motion and the second motion oscillates with a second oscillating motion that is faster than the first oscillating motion.

19. The applicator of claim 13, wherein the first motion is a rotating motion and the second motion is a translating motion.

20. The applicator of claim 13, wherein the first motion is a rotating motion and the second motion is a vibrating motion.

21. The applicator of claim 13, wherein the first motion is a rotating motion and the second motion is an oscillating motion.

22. The applicator of claim 13, wherein the first motion is an oscillating motion and the second motion is a motion selected from the group including: a translating motion and a vibrating motion.

* * * * *